US005551087A

United States Patent [19]

Blutstein et al.

[11] Patent Number: 5,551,087

[45] Date of Patent: Sep. 3, 1996

[54] HAT AND FACE MASK COMBINATION

[75] Inventors: Morton Blutstein, Milwaukee; Darwin Ulrich, Mequon, both of Wis.

[73] Assignee: Reliable Knitting Works, Milwaukee, Wis.

[21] Appl. No.: 447,495

[22] Filed: May 23, 1995

[51] Int. Cl.[6] ..... A42B 3/18

[52] U.S. Cl. ..... 2/173; 2/9; 2/195.8; 2/206; 2/424

[58] Field of Search ..... 2/9, 173, 195.7, 2/195.8, 206, 423, 424

[56] References Cited

U.S. PATENT DOCUMENTS

| | | | |
|---|---|---|---|
| 640,412 | 1/1900 | Petersen . | |
| 1,235,927 | 8/1917 | Sanborn . | |
| 2,344,811 | 3/1944 | Gill | 2/2 |
| 2,362,597 | 11/1944 | Vince | 2/9 |
| 2,365,656 | 12/1944 | Lamsa | 2/4 |
| 2,869,132 | 1/1959 | Drummond | 2/4 |
| 2,909,782 | 10/1959 | Mizell | 2/9 |
| 2,998,611 | 9/1961 | Schuessier | 2/202 |
| 3,271,781 | 9/1966 | Sontag et al. | 2/202 |
| 3,531,952 | 10/1970 | Chesebro, Jr. | 66/171 |
| 3,582,989 | 6/1971 | Fassbender | 2/4 |
| 3,717,882 | 2/1973 | Schuessier | 2/173 |
| 3,740,767 | 6/1973 | Schuessier | 2/173 |
| 4,300,240 | 11/1981 | Edwards | 2/206 |
| 4,395,781 | 8/1983 | Myers | 2/4 |
| 4,397,044 | 8/1983 | Trepanier | 2/4 |
| 4,422,184 | 12/1983 | Myers | 2/4 |
| 4,825,474 | 5/1989 | Edwards | 2/206 |
| 4,941,211 | 7/1990 | Blutstein | 2/202 |
| 5,146,622 | 9/1992 | Blutstein | 2/4 |

FOREIGN PATENT DOCUMENTS

| | | |
|---|---|---|
| 159730 | 4/1940 | Germany . |
| 102213 | 8/1941 | Sweden . |
| 625684 | 9/1978 | U.S.S.R. . |
| 684962 | 12/1952 | United Kingdom . |

*Primary Examiner*—Diana Biefeld
*Attorney, Agent, or Firm*—Michael, Best & Friedrich

[57] ABSTRACT

The invention provides a hat and face mask combination including a hat which is made of a stretchable knit material to conform to the head of an individual wearer and which includes a peripheral edge defining an opening for the face of the wearer. The opening is sized to expose that portion of a wearer's face which extends from above the eyebrows, over the temples, and to the cheeks. The hat also includes a lower portion that is rollable over on itself to form an ear covering of double thickness. The lower portion of the hat is fixed in its rolled over position along the periphery of the face opening and is unrollable, except along the periphery of the face opening, to extend the lower portion of the hat downwardly over a portion of the neck of the wearer. The head covering also includes a face mask that extends over the face opening and that includes a periphery sewn to the hat along the periphery of the face opening.

14 Claims, 3 Drawing Sheets

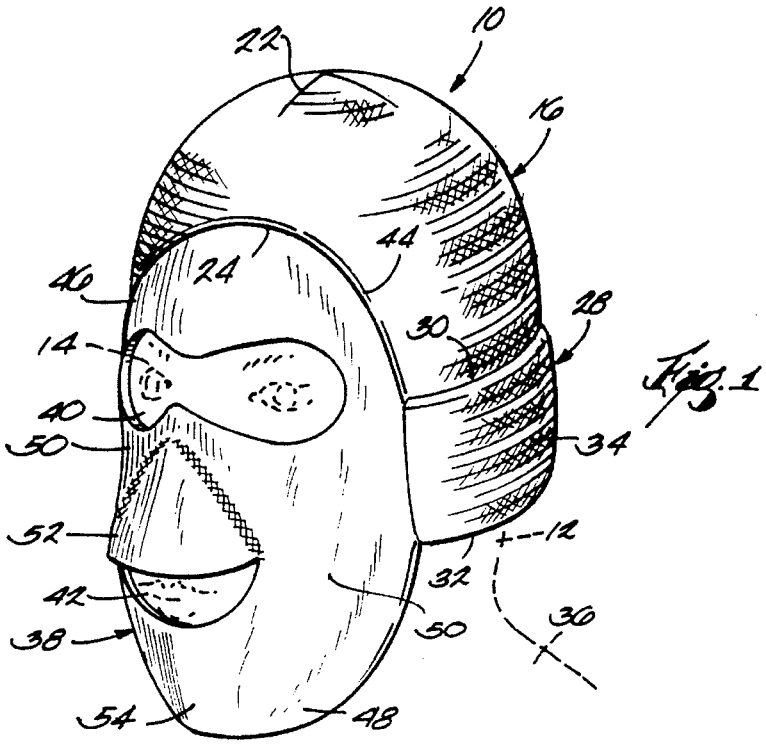
Fig. 1
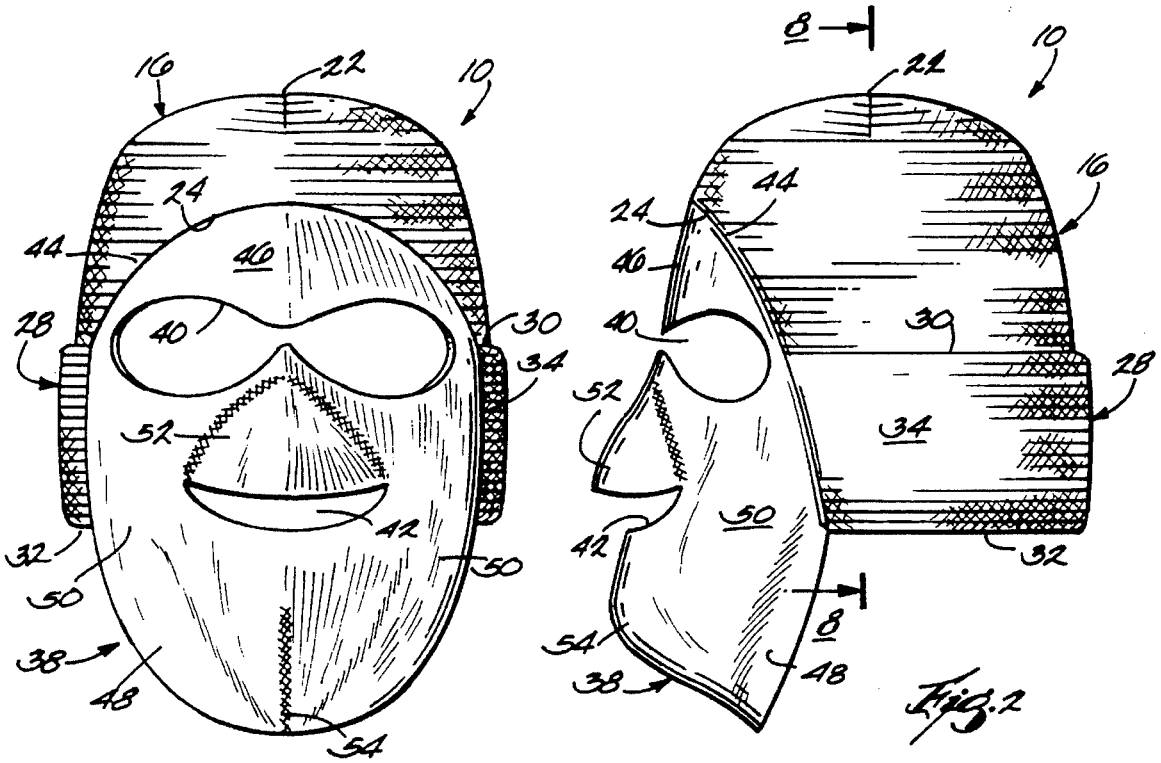
Fig. 2
Fig. 3

HAT AND FACE MASK COMBINATION

FIELD OF THE INVENTION

The present invention relates to head garments or coverings, and more particularly to head coverings including hats or hoods in combination with face masks.

REFERENCE TO PRIOR ART

Knit caps which cover part of the head of a wearer are well known and are widely used for protection from the cold. Those caps are often worn with the lower portions thereof rolled up over the ears of the wearer, leaving the face and neck of the wearer exposed to the elements. When an individual is subjected to prolonged exposure or severe environmental conditions it may be desirable to replace a knit cap with a head covering that affords greater protection from the elements.

Head garments or coverings that each include a hood portion which extends downwardly over the neck of a wearer and a face mask portion which covers part of the face of the wearer are also known. One type of head covering designed to cover more of a wearer's head than a knit cap consists of a knit pullover which covers the head, face and neck of a wearer, except for eye and possibly nose and mouth openings. Examples of pullover head coverings are illustrated in U.S. Pat. Nos. 1,235,927, 3,717,882 and 3,740,767.

In addition to use for protection from the elements, pullover type head coverings are often donned by hunters for concealment from game. An example of such a hood is provided in U.S. Pat. No. 5,146,622. That patent illustrates a hunting hood that includes a nylon net face cover for concealment from game and protection from insects.

An example of another pullover type head covering is provided in U.S. Pat. No. 4,941,211. That patent illustrates a cold weather hood for hunters (i.e., is colored with camouflage patterns, hunter blaze orange, etc.) that is designed for use in cold weather. The cold weather hood includes a knit hood member that covers the wearer's head and neck and that is provided with a face opening in which a face mask is sewn. The face mask is made of double-sided brushed polyester fabric, such as DACRON, for warmth and comfort.

Pullover type head coverings can be uncomfortable or somewhat confining when worn for extended periods of time. Pullovers also do not readily permit the use of the face covering or mask portion of that garment unless the hood portion is also worn over the head and neck. For example, mild environmental conditions or comfort may make removal of the hood from at least part of the head desirable. However, a hunter cannot use the face mask unless the hood is also substantially completely in position over the head. This is disadvantageous where use of the face mask for concealment of the face and partial exposure of the neck and part of the head for comfort is desired.

SUMMARY OF THE INVENTION

The present invention provides an improved head covering that combines a face mask with a hood or hat. The hat is adjustable to increase or decrease head and neck coverage without interfering with face mask use. In particular, the hat is wearable as a cap over the top of the head of a wearer and provides an opening for the wearer's face. The face mask extends across that opening. The hat also has a lower portion that is rolled over on itself over the ears of a wearer. The lower portion of the hat is sewn to the face mask in its rolled over position so that the lower portion maintains that position along the periphery of the face opening. With that arrangement, the face mask is capable of being worn continually for protection from the cold or concealment from game while the hat can be worn with the lower portion rolled up over the ears or unrolled over additional parts of the head and neck for increased protection from the elements or increased camouflage coverage.

More particularly, the invention provides a hat and face mask combination including a hat adapted to cover the head of a wearer. The hat defines an opening for the face of the wearer and includes a lower portion having a lower periphery. The lower portion has a rolled over position wherein the lower portion is rolled over upon itself to provide a double thickness along the lower periphery, and the lower portion is fixed in the rolled over position along the periphery of the opening. The hat and face mask combination also includes a face mask adapted to cover the face of the wearer. The face mask extends over the opening and is secured to the hat along the periphery of the opening. In one embodiment the face mask extends well below the hat when the hat is worn by a wearer, and the lower periphery of the hat and the periphery of the opening intersect at about the cheek of a wearer.

The invention also provides a head covering including a hat adapted to cover the head of a wearer, the hat including a lower portion and a peripheral edge defining an opening for the face of the wearer. The lower portion of the hat is rollable over on itself to provide an ear covering of double thickness, and the lower portion of the hat is fixed in its rolled over position along the peripheral edge of the hat so that the lower portion of the hat permanently retains its double thickness along the peripheral edge. The lower portion of the hat is also unrollable, except along the peripheral edge of the hat, to extend the lower portion of the hat downwardly over at least part of the neck of a wearer. The head covering also includes a face mask which extends over the opening defined by the hat and which is secured to the hat along the peripheral edge.

The invention further provides a hat and face mask combination including a hat made of a stretchable knit material to conform to the head of an individual wearer. The hat includes a peripheral edge defining a face opening sized to expose that portion of a wearer's face which extends from above the eyebrows, over the temples, and to the cheeks. The hat also includes a lower portion which is rollable over on itself to form an ear covering of double thickness and which is fixed in its rolled over position along the peripheral edge of the hat so that the lower portion of the hat permanently retains its double thickness along the peripheral edge of the hat. The lower portion of the hat is also unrollable, except along the peripheral edge of the hat, to extend the lower portion of the hat downwardly over a part of the neck of a wearer. The hat and face mask combination also includes a face mask which extends over the opening in the hat to cover the face of a wearer. The face mask includes a periphery sewn to the peripheral edge of the hat, and the face mask extends beneath the chin of the wearer and below the hat when the head covering is in place on the head of a wearer.

Other features and advantages of the invention will become apparent to those skilled in the art upon review of the following detailed description, claims and drawings.

BRIEF DESCRIPTION OF THE DRAWINGS

FIG. 1 is a perspective view of a head covering which embodies the invention and which is shown in position over the head and face of a schematically illustrated wearer.

FIG. 2 is a side elevational view of the head covering illustrated in FIG. 1;

FIG. 3 is a front elevational view thereof;

Figure 4:
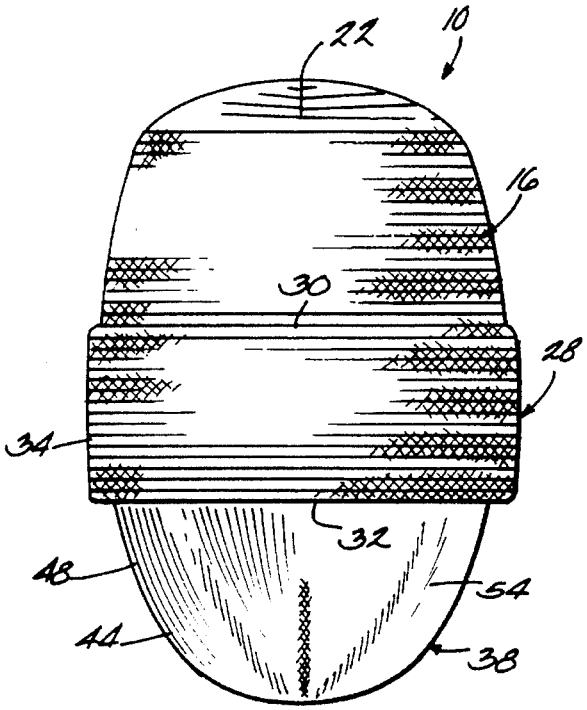
FIG. 4 is a rear elevational view thereof.
Figure 5:
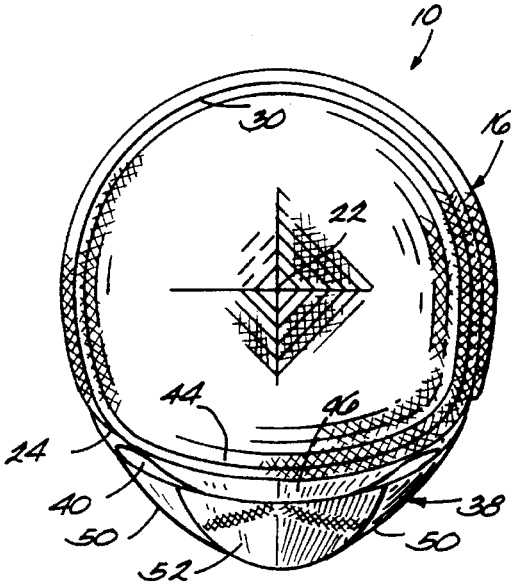
FIG. 5 is a top plan view thereof.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Illustrated in FIG. 1 is a head covering 10 which embodies the invention and which is shown worn over the head 12 and face 14 of a wearer (shown schematically). In the illustrated embodiment the head covering 10 is a hat and face mask combination.

Figure 8:
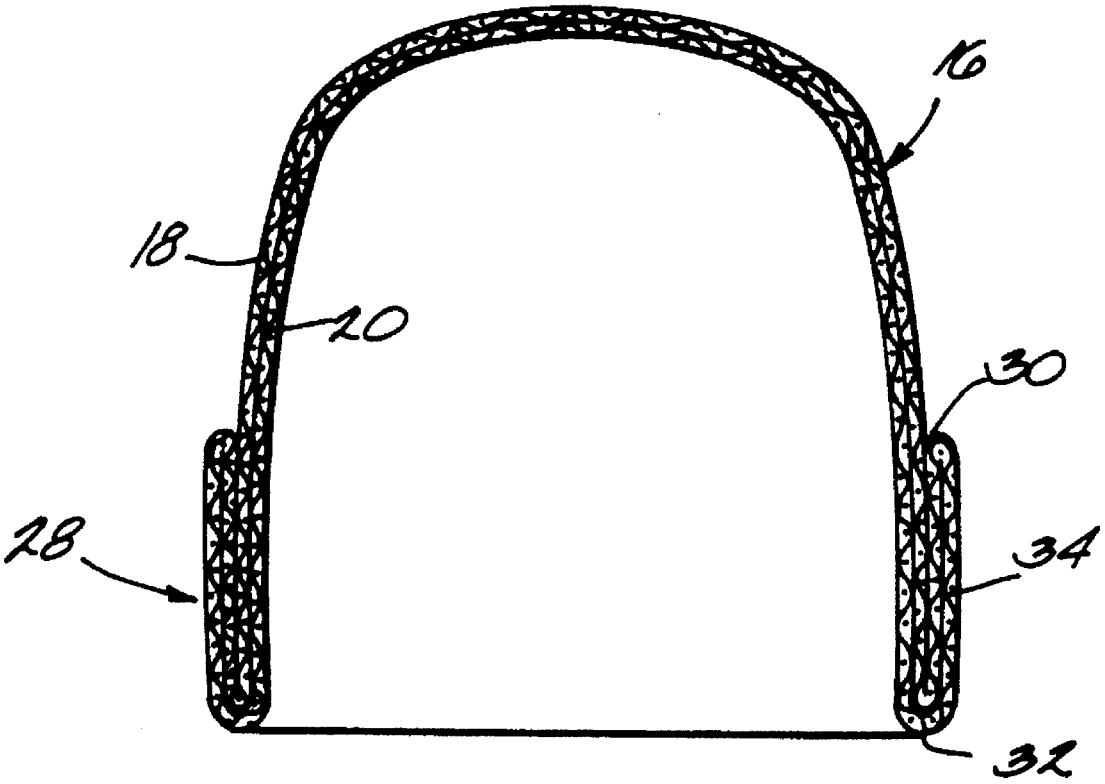
FIG. 8 is a cross sectional view taken along line 8—8 in FIG. 2.

The head covering 10 includes a hood portion or hat 16 that is preferably made of a stretchable knit material to conform to the head of each individual wearer. As shown in FIG. 8, the knit material is two-ply to provide increased thickness and has a first or outer layer 18 and a second or inner layer 20. The outer and inner layers 18 and 20 are formed as a continuously knit unit in which the inner layer 20 is inverted and the layers 18 and 20 are sewn together where indicated by reference numeral 22 to form the hat 16. In one embodiment the head covering 10 is intended for use by hunters and is reversible with the outer layer 18 colored to provide a camouflaged appearance and part of the inner layer 20 colored blaze or hunter orange. The head covering 10 could also be provided with other color patterns or combinations, as desired.

The hat 16 includes a peripheral edge 24 which in the particular embodiment illustrated in the drawings is generally parabolically-shaped and defines an opening for the face of a wearer. That face opening is sized to expose that portion of a wearer's face 14 which extends from above the eyebrows, over the temples, and to the cheeks of the wearer.

The hat 16 also includes a lower portion 28. The lower portion 28 includes a terminal lower edge 30 and a lower periphery 32 that intersects the peripheral edge 24 (i.e., the periphery of the face opening) at the cheek of a wearer when the head covering 10 is worn. As shown in FIGS. 1–6, the lower portion 28 has a first or rolled over position wherein it is rolled or doubled over upon itself to provide a double thickness along the lower periphery 32. In that position the terminal lower edge 30 is positioned along its entire length above the lower periphery 32 and the area of double thickness forms an ear covering 34. The lower portion 28 is sewn or otherwise suitably fixed in its rolled over position along the peripheral edge 24 and permanently retains its double thickness along that edge. If desired, the lower portion 28 can be unrolled (see FIG. 7) to cover additional parts of the head 12 and the neck 36 of the wearer for added concealment from game or protection of those areas from the elements. In the unrolled position, except in the area adjacent the peripheral edge 24, the terminal lower edge 30 becomes the lower periphery 32 and the lower portion 28 has a single thickness.

Figure 7:
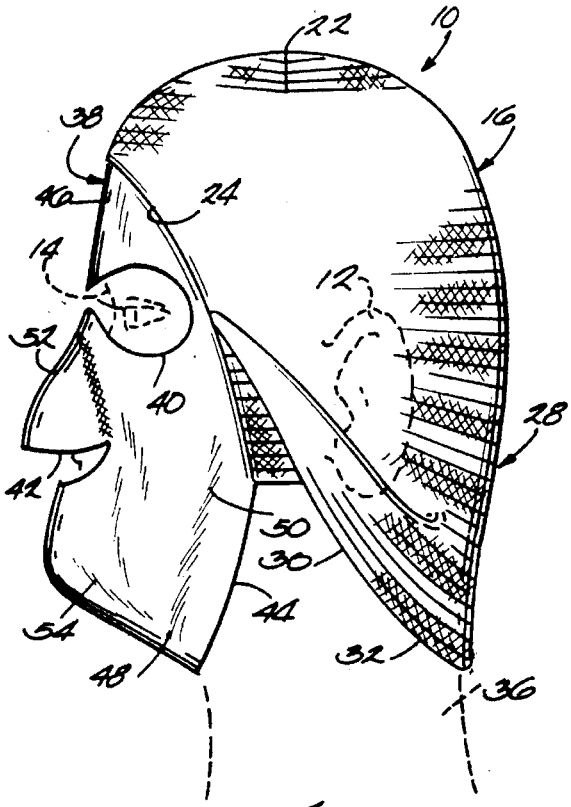
FIG. 7 is a side elevational view of the head covering shown in FIG. 1 but with the hat rolled down over parts of the head and neck of the wearer.
Figure 6:
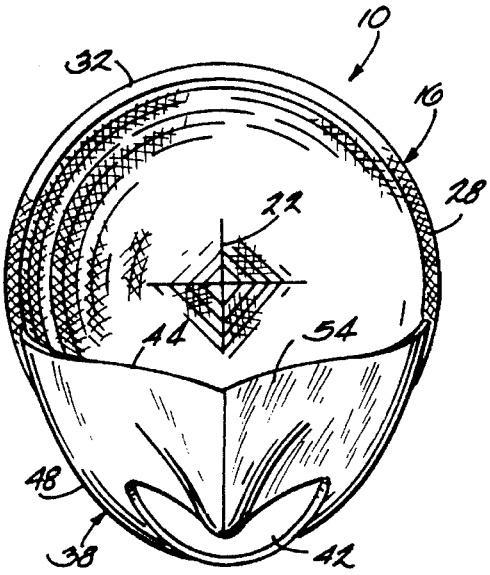
FIG. 6 is a bottom plan view thereof.

The head covering 10 also includes a face covering or mask 38 to cover the face 14 of a wearer. The face mask 38 is preferably made a double-sided brushed polyester fabric such as that sold under the brand name POLARTEC. A suitable substitute material is sold under the brand name HUNT-CLOTH and is described in U.S. Pat. No. 5,059,452. In the illustrated embodiment, the face mask 38 is configured to conform to the contours of the face 14 of a wearer and is provided with an elongated eye opening 40 and a nose and mouth opening 42. The face mask 38 is positioned in the face opening of the hat 16 and includes a periphery 44 that is secured by sewing or other suitable means to the peripheral edge 24 of the hat 16. The face mask 38 also includes an upper portion 46 and a lower portion 48. The lower portion 48 of the face mask 38 includes opposite cheek sections 50 at which the lower periphery 32 and the peripheral edge 24 of the hat 16 intersect, a nose section 52, and a chin section 54. The chin section 54 fits over and extends underneath the chin of a wearer. As shown in FIGS. 1 and 7, the lower portion 48 extends well below the lower periphery 32 of the hat 16 when the head covering 10 is worn.

Advantageously, the head covering 10 can be worn in a number of positions to maximize comfort and/or concealment of the wearer. For example, the head covering 10 can be worn with the face mask 38 in position over the wearer' face 14 and the ear covering 34 rolled up over the wearer's ears (FIG. 1) or rolled down over additional parts of the head and neck of the wearer (FIG. 7). The head covering 10 can also be worn with the face mask 38 pulled up or rolled up off the face, if desired.

Various features of the invention are set forth in the following claims.

We claim:

1. A hat and face mask combination comprising a hat adapted to cover the head of a wearer, the hat defining an opening for the face of a wearer, said opening having a periphery, and the hat including a lower portion, the lower portion having a lower periphery, and the lower portion having a rolled over position wherein the lower portion is rolled over upon itself to provide a double thickness along the lower periphery, the lower portion being fixed in the rolled over position along the periphery of the opening, and a face mask adapted to cover the face of a wearer, the face mask extending over the opening, and the face mask being secured to the hat along the periphery of the opening.

2. A hat and face mask combination as set forth in claim 1 wherein the hat includes a terminal lower edge, the terminal lower edge being positioned above the lower periphery of the hat when the lower portion of the hat is in the rolled over position and the hat and face mask combination is worn over the head of a wearer.

3. A hat and face mask combination as set forth in claim 1 wherein the lower portion of the hat has a portion adjacent the periphery of the opening and an unrolled position in which the lower portion of the hat has a single thickness except the portion adjacent the periphery of the opening, and wherein the hat includes a terminal lower edge, the terminal lower edge becoming the lower periphery of the hat, except the portion adjacent the periphery of the opening, when the lower portion of the hat is in the unrolled position and the hat and face mask combination is worn over the head of a wearer.

4. A hat and face mask combination as set forth in claim 1 wherein the face mask extends below the hat when the hat is worn by a wearer.

5. A hat and face mask combination as set forth in claim 4 wherein the lower periphery of the hat and the periphery of the opening intersect at the cheek of a wearer when the hat and face mask combination is worn by a wearer, and wherein the face mask includes a lower portion adapted to fit over the chin of the wearer and to extend below the chin of a wearer when the hat and face mask combination is worn by a wearer.

6. A hat and face mask combination as set forth in claim 1 wherein the hat is made of a stretchable knit material to conform to the head of an individual wearer, and wherein the opening in the hat is sized to expose that portion of a wearer's face which extends from above the eyebrows, over the temples, and to the cheeks, and wherein the face mask has a periphery sewn to the periphery of the opening on the hat, and the face mask being adapted to extend beneath the chin of a wearer.

7. A head covering comprising a hat adapted to cover the head of a wearer, the hat including a peripheral edge defining an opening for the face of a wearer, and the hat including a lower portion, the lower portion of the hat being rollable over on itself to provide an ear covering of double thickness, the lower portion of the hat being fixed in its rolled over position along the peripheral edge of the hat so that the lower portion of the hat permanently retains its double thickness along the peripheral edge of the hat, and the lower portion of the hat being unrollable, except along the peripheral edge of the hat, to extend the lower portion of the hat downwardly over a portion of the neck of a wearer, and a face mask adapted to cover at least a portion of the face of a wearer, the face mask extending over the opening, and the face mask being secured to the hat along the peripheral edge.

8. A head covering as set forth in claim 7 wherein the hat includes a lower periphery, and a terminal lower edge, the terminal lower edge being positioned above the lower periphery of the hat when the lower portion of the hat is in the rolled over position and the head covering is worn over the head of a wearer.

9. A head covering as set forth in claim 8 wherein the terminal lower edge forms the lower periphery of the hat, except in the area adjacent the peripheral edge of the hat, when the lower portion of the hat is unrolled.

10. A head covering as set forth in claim 9 wherein the face mask extends below the lower periphery of the hat.

11. A head covering as set forth in claim 9 wherein the lower periphery of the hat and the peripheral edge of the hat intersect at the cheek of a wearer when the head covering is worn by the wearer, and wherein the face mask includes a lower portion adapted to fit over the chin of a wearer and to extend below the chin of the wearer when the head covering is worn by the wearer, the lower portion of the face mask extending downwardly from the intersection between the lower periphery of the hat and the peripheral edge of the hat.

12. A head covering as set forth in claim 11 wherein the hat is made of a stretchable knit material to conform to the head of an individual wearer, and wherein the opening in the hat is sized to expose that portion of a wearer's face which extends from above the eyebrows, over the temples, and to the cheeks, and wherein the face mask has a periphery sewn to the peripheral edge of the hat.

13. A hat and face mask combination comprising a hat adapted to cover the head of a wearer, the hat being made of a stretchable knit material to conform to the head of an individual wearer, the hat including a peripheral edge defining an opening for the face of a wearer, the opening being sized to expose that portion of a wearer's face which extends from above the eyebrows, over the temples, and to the cheeks, and the hat including a lower portion having an area adjacent the peripheral edge, the lower portion of the hat being rollable over on itself to form an ear covering of double thickness, the lower portion of the hat being fixed in its rolled over position along the peripheral edge of the hat so that the lower portion of the hat permanently retains its double thickness along the peripheral edge of the hat, and the lower portion of the hat being unrollable, except along the peripheral edge of the hat, to extend the lower portion of the hat downwardly over a portion of the neck of a wearer, the lower portion of the hat, when unrolled, having a single thickness except the area adjacent the peripheral edge of the hat, and a face mask adapted to cover at least a portion of the face of a wearer, the face mask extending over the opening, the face mask including a periphery sewn to the peripheral edge of the hat, and the face mask being adapted to extend beneath the chin of a wearer and below the hat when the head covering is worn by the wearer.

14. A hat and face mask combination as set forth in claim 13 wherein the lower portion of the hat includes a lower periphery, and a terminal edge, wherein the terminal edge is positioned above the lower periphery when the lower portion of the hat is rolled over, wherein the terminal edge forms most of the lower periphery when the lower portion of the hat is unrolled, wherein the terminal edge and the peripheral edge intersect at the cheek of a wearer when the hat and face mask combination is worn by the wearer, and wherein the face mask includes a lower portion adapted to fit over the chin of a wearer, the lower portion of the face mask extending downwardly from the intersection between the terminal edge and the peripheral edge.

* * * * *